US007892049B1

(12) United States Patent
Andler et al.

(10) Patent No.: US 7,892,049 B1
(45) Date of Patent: Feb. 22, 2011

(54) ELECTRICAL CONNECTOR ASSEMBLIES

(75) Inventors: John J. Andler, Rochester Hills, MI (US); Daniel C. DeGroote, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 12/543,321

(22) Filed: Aug. 18, 2009

(51) Int. Cl.
*H01R 4/30* (2006.01)

(52) U.S. Cl. ..... 439/801; 439/883

(58) Field of Classification Search ..... 439/801, 439/883, 766, 813, 860
See application file for complete search history.

(56) References Cited

U.S. PATENT DOCUMENTS 1,048,574 A * 12/1912 Newbold ..... 439/709
1,213,632 A * 1/1917 Hammond ..... 439/860
1,233,197 A * 7/1917 Cuthbert ..... 439/808
1,921,823 A * 8/1933 Hosking ..... 439/883
2,350,765 A * 6/1944 Johnson ..... 439/879
3,622,954 A * 11/1971 Hovnanian et al. ..... 439/865
4,002,390 A * 1/1977 Perry et al. ..... 439/433
4,679,888 A * 7/1987 Williams ..... 439/883
4,744,765 A * 5/1988 DeLeo ..... 439/92
4,775,339 A * 10/1988 Sasaki et al. ..... 439/791
4,795,380 A * 1/1989 Frantz ..... 439/860
4,832,629 A * 5/1989 Sasaki et al. ..... 439/792
5,207,588 A * 5/1993 Ladouceur et al. ..... 439/84
5,442,133 A * 8/1995 Arnold et al. ..... 174/51
5,489,176 A 2/1996 Fultz
5,644,830 A * 7/1997 Ladouceur et al. ..... 29/432.2
5,655,936 A * 8/1997 Meredith ..... 439/801
5,759,055 A * 6/1998 Colantuano et al. ..... 439/287
6,027,382 A * 2/2000 Reindl et al. ..... 439/793
6,042,431 A * 3/2000 Hayakawa ..... 439/801
6,053,780 A * 4/2000 Ono et al. ..... 439/810
6,077,096 A * 6/2000 Moring et al. ..... 439/92
6,126,493 A * 10/2000 Price et al. ..... 439/801
6,244,517 B1 * 6/2001 Courtois et al. ..... 238/14.05
6,250,975 B1 * 6/2001 LaPointe ..... 439/883
6,280,263 B1 * 8/2001 Manor et al. ..... 439/801
6,357,110 B1 * 3/2002 Shipp et al. ..... 29/825
6,433,278 B1 8/2002 Blank et al.
6,491,487 B1 * 12/2002 Wojciechowski ..... 411/181
6,599,137 B2 * 7/2003 Modina ..... 439/92
6,746,285 B2 * 6/2004 Delcourt et al. ..... 439/766
6,855,012 B2 * 2/2005 An ..... 439/793
6,864,015 B2 * 3/2005 Peterson et al. ..... 429/182
6,877,997 B2 * 4/2005 Schaty ..... 439/92
7,056,161 B2 * 6/2006 Delcourt et al. ..... 439/766
7,156,670 B2 * 1/2007 Schaty ..... 439/92
7,281,962 B2 * 10/2007 Dolzer et al. ..... 439/883
7,549,889 B2 * 6/2009 Sikora ..... 439/388
7,553,200 B2 * 6/2009 Plummer ..... 439/766
7,788,802 B2 * 9/2010 Schaty ..... 29/876
7,794,265 B2 * 9/2010 Sikora ..... 439/388
2002/0115317 A1 * 8/2002 Delcourt et al. ..... 439/84

(Continued)

*Primary Examiner*—Ross N Gushi
(74) *Attorney, Agent, or Firm*—Ingrassia Fisher & Lorenz, P.C.

(57) ABSTRACT

An electrical connector assembly having a wiring harness terminal includes a body and a protrusion. The protrusion extends from the body, and is configured to mate with the wiring harness terminal. The protrusion comprises six sides. Four of the sides have a first length, and two of the sides having a second length that is different from the first length.

20 Claims, 1 Drawing Sheet

U.S. PATENT DOCUMENTS

2003/0017391 A1* 1/2003 Peterson et al. ..... 429/182
2006/0093456 A1* 5/2006 Delcourt ..... 411/171
2007/0270002 A1* 11/2007 Braden et al. ..... 439/92
2008/0032570 A1* 2/2008 Hitomi et al. ..... 439/883

* cited by examiner

ELECTRICAL CONNECTOR ASSEMBLIES

TECHNICAL FIELD

The present invention generally relates to the field of electrical connectors, and, more specifically, to electrical connector assemblies of vehicles, such as automobiles.

BACKGROUND

Various vehicles and other devices and systems have electrical connector assemblies connecting various components thereof. The electrical connector assemblies generally include a grounding mechanism, such as a grounding stud, that is electrically coupled to a wiring harness terminal of the electrical connector assembly. The types of grounding mechanisms may vary. However, it is generally important that the grounding mechanism effectively mate with whichever wiring harness terminal is used in connection with the particular electrical connector assembly. In addition, in various instances it is also important that the grounding mechanism does not cause unwanted rotation of a wire that is used in connection with the wiring harness terminal of the electrical connector assembly, for example when the grounding stud is assembled or disassembled.

Accordingly, it is desirable to provide an improved electrical connector assembly, such as for a vehicle, for example that effectively mates with commonly used wiring harness terminals and that provides a reduction or an elimination in unwanted rotation of one or more wires that are used in connection with the wiring harness terminal of the electrical connector assembly, for example when the grounding stud is assembled or disassembled. Furthermore, other desirable features and characteristics of the present invention will be apparent from the subsequent detailed description and the appended claims, taken in conjunction with the accompanying drawings and the foregoing technical field and background.

BRIEF SUMMARY

In accordance with an exemplary embodiment, an electrical connector assembly having a wiring harness terminal is provided. The electrical connector assembly comprises a body and a protrusion. The protrusion extends from the body, and is configured to mate with the wiring harness terminal. The protrusion comprises six sides. Four of the sides have a first length, and two of the sides having a second length that is different from the first length.

In accordance with a further exemplary embodiment, an electrical connector assembly is provided. The electrical connector assembly comprises a grounding stud and a wiring harness terminal. The grounding stud comprises a body and a protrusion. The protrusion extends from the body, and comprises a first surface, a second surface, a third surface, a fourth surface, a fifth surface, and a sixth surface. The first surface has a first length. The second surface is connected to the first surface, and has a second length. The third surface is connected to the second surface, and has a third length. The fourth surface is connected to the third surface, and has a fourth length. The fifth surface is connected to the fourth surface, and has a fifth length. The sixth surface is connected to the fifth surface and the first surface, and has a sixth length. The third length and the sixth length are each different from the first length, the second length, the fourth length, and the fifth length. The wiring harness terminal is coupled to and configured to mate with the protrusion.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Figure 1:
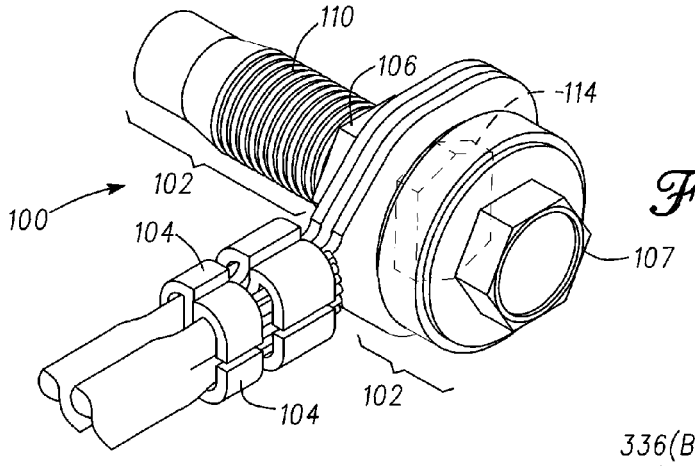
FIG. 1 is an isometric view of an electrical connector assembly (e.g., for use on a vehicle), in accordance with an exemplary embodiment.
Figure 2:
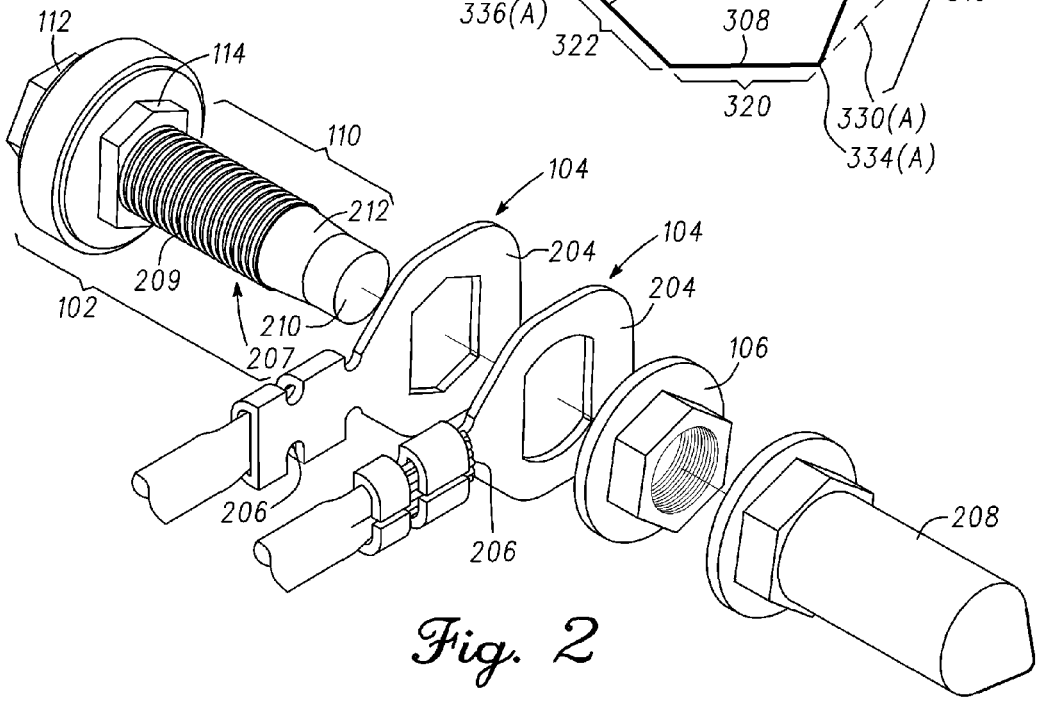
FIG. 2 is an exploded view of the electrical connector assembly of FIG. 1, in accordance with an exemplary embodiment.

FIGS. 1 and 2 present an isometric view and an exploded view, respectively, of an electrical connector assembly 100, in accordance with exemplary embodiments. In one exemplary embodiment, the electrical connector assembly 100 is used in an engine compartment of a vehicle, such as an automobile. For example, in one exemplary embodiment, the electrical connector assembly 100 conducts electricity from an electrical component of the vehicle to a conductive metal component of the vehicle. For example, in certain exemplary embodiments, the electrical connector assembly 100 conducts electricity from a battery, a motor, a window operating unit, a power door operating unit, a vehicle entertainment unit, and/or any number other different units, components, or modules of a vehicle to a metal panel or frame of the vehicle. However, in various other embodiments, the electrical connector assembly 100 can be used in connection with any number of other different types of vehicles and/or components thereof, and/or in connection with any number of other different types of devices and/or systems.

In the depicted embodiments, the electrical connector assembly 100 includes a grounding element 102, two wiring harness terminals 104, and a nut 106. It will be appreciated that the number of wiring harness terminals 104 may vary in other embodiments. For example, in certain embodiments, the electrical connector assembly 100 may include one wiring harness terminal 104. In yet other embodiments, the electrical connector assembly 100 may include more than two wiring harness terminals 104.

The grounding element 102 comprises a stud and nut assembly. In certain embodiments, an apparatus for such an electrical connector assembly 100 may include the grounding element 102 without the wiring harness terminals 104 and/or without the nut 106, for example for use in mating with one or more wiring harness terminals 104 and/or for use in connection with a nut 106. In one exemplary embodiment depicted in FIG. 2, a protective cap 208 (for example, made of plastic) may be used instead of or in addition to the nut 106. In addition, in various other embodiments, various other components and/or features may be included as part of or in connection with such an apparatus and/or the electrical connector assembly 100.

In a preferred embodiment, the grounding element 102 comprises a grounding stud that is configured to be welded into a metal panel or frame of a vehicle. However, this may vary in other embodiments. For example, in certain embodiments, the grounding element 102 comprises a bolt and/or other grounding components that are secured to the metal panel or frame of a vehicle through a hole in the metal panel or frame of the vehicle. In one preferred embodiment, an M6 stud is used. However, in various other embodiments, studs and/or nuts of different diameters may be used.

The grounding element 102 comprises a weld tip or weld base 107, a body 110, a securing mechanism 112, and a protrusion 114. The protrusion 114 is depicted in phantom in FIG. 1, as the protrusion 114 is covered by the nut 106 in FIG. 1. In a preferred embodiment, the body 110 comprises a shaft. The securing mechanism 112, depicted in FIG. 2, is preferably disposed at one end of the grounding element 102. In a preferred embodiment, the securing mechanism 112 is used to secure the grounding element 102 to the metal panel or frame of a vehicle via welding.

Also in a preferred embodiment, the body 110 and the protrusion 114 are formed integral with one another. In certain embodiments, such as that depicted in FIG. 2, the body 110 includes a base portion 207, an anti-cross threading segment 210, and an inwardly tapered segment 212. However, this may vary in other embodiments. Also in certain embodiments, the base portion 207 of the body 110 includes threads 209, for example as also shown in FIG. 2. However, this may also vary in other embodiments.

The protrusion 114 is preferably disposed near a second end of the grounding element 102 opposite the securing mechanism 112. The protrusion 114 is configured to mate with a face 204 of one or more of the wiring harness terminals 104. In one exemplary embodiment, the protrusion 114 is configured to mate with a different face 204 of both of the wiring harness terminals 104 of FIGS. 1 and 2. In another exemplary embodiment, the protrusion 114 is configured to mate with a face 204 of one of the wiring harness terminals 104 of FIGS. 1 and 2. The wiring harness terminals 104 are preferably inserted between the grounding element 102 and the nut 106.

The protrusion 114 reduces or prevents rotation of one or more wires 206 of the wiring harness terminals 104. As shown in FIG. 2, in one preferred embodiment, a diameter of the protrusion 114 is slightly larger than a diameter of the body 110. However, this may vary in other embodiments. For example, in certain embodiments, the diameter of the protrusion 114 may be larger than that depicted in FIG. 2.

Figure 3:
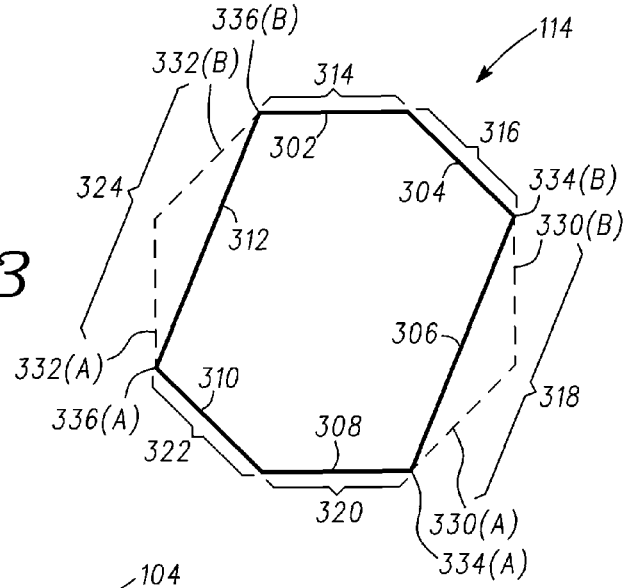
FIG. 3 is a close-up cross-sectional view of a component of the connector assembly of FIGS. 1 and 2, namely a protrusion of the connector assembly of FIGS. 1 and 2, in accordance with an exemplary embodiment.

Turning now to FIG. 3, a close-up, cross-sectional view of the protrusion 114 is provided. As depicted in FIG. 3, the protrusion 114 has six sides. Specifically, the protrusion 114 has a first side 302, a second side 304, a third side 306, a fourth side 308, a fifth side 310, and a sixth side 312. The first side 302 has a first length 314. The second side 304 has a second length 316. The third side 306 has a third length 318. The fourth side 308 has a fourth length 320. The fifth side 310 has a fifth length 322. The sixth side 312 has a sixth length 324.

Also as depicted in FIG. 3, the third side 306 and the sixth side 312 are preferably on opposite sides of the protrusion 114 from one another. Specifically, in the depicted embodiment, the first side 302 is connected between the second side 304 and the sixth side 312; the second side 304 is connected between the first side 302 and the third side 306; the third side 306 is connected between the second side 304 and the fourth side 308; the fourth side 308 is connected between the third side 306 and the fifth side 310; the fifth side 310 is connected between the fourth side 308 and the sixth side 312; and the sixth side 312 is connected between the fifth side 310 and the first side 302.

The third length 318 and the sixth length 324 are different from the first length 314, the second length 316, the fourth length 320, and the fifth length 322. Also in a preferred embodiment, the first length 314, the second length 316, the fourth length 320, and the fifth length 322 are each equal to one another. In addition, in a preferred embodiment, the third length 318 and the sixth length 324 are each greater than each of the first length 314, the second length 316, the fourth length 320, and the fifth length 322.

As depicted in FIG. 3, the geometric pattern of the protrusion 114 is preferably a modified hexagon that would be formed from eliminating two pairs of opposing sides (i) 330(A) and 330(B) and (ii) 332(A) and 332(B) of an octagon of FIG. 3 and connecting two resulting sets of pairs of connected points (i) 334(A) and 334(B) and (ii) 336(A) and 336(B) of FIG. 3 within each respective pair. Specifically, in one preferred embodiment depicted in FIG. 3, sides 330(A) and 330(B) of an octagon would be replaced by the above-referenced third side 306 of the modified hexagon of FIG. 3 by connecting points 334(A) and 334(B) together. Similarly, also in a preferred embodiment depicted in FIG. 3, sides 332(A) and 332(B) of an octagon would be replaced by the above-referenced sixth side 312 of the modified hexagon of FIG. 3 by connecting points 336(A) and 336(B) together.

Returning now to FIGS. 1 and 2, each wiring harness terminal 104 includes the above-referenced face 204 and wires 206. The face 204 is configured to be coupled to and mate with the protrusion 114 of the grounding element 102, to thereby provide grounding for the wires 206 to the metal panel or frame of the vehicle. In a preferred embodiment, each of the wiring harness terminals 104 are secured to the protrusion 114 of the grounding element 102 via the above-referenced nut 106, for example during manufacturing of a vehicle having the electrical connector assembly 100.

In the depicted embodiment, the face 204 of one of the wiring harness terminals 104 has the same modified hexagon shape as the protrusion 114 described above, with two opposing sides each having a relatively longer length, and with the remaining four sides each having a relatively smaller length. In various other embodiments, the faces 204 of one or more of the wiring harness terminals 104 may have one or more other shapes, such as an octagonal shape as known in the art, among other possible shapes.

In either of these exemplary embodiments, the protrusion 114 of the grounding element 102 effectively mates with the face 204 of at least one of the wiring harness terminals 104. In addition, the various points and geometry of the protrusion 114 effectively reduce or eliminate unwanted rotation of the wires 206, for example when the grounding element 102 is assembled or disassembled, when the nut 106 is tightened toward or loosened away from the wiring harness terminals 104, and/or when the electrical connector assembly 100 is assembled, for example during manufacturing of the electrical connector assembly 100 and/or the vehicle, or disassembled, for example during service of the electrical connector assembly 100 and/or the vehicle.

Additionally, an improved electrical connector assembly, such as for a vehicle, is provided. The improved electrical connector assembly includes an apparatus, such as a grounding stud, with a protrusion having a modified hexagon geometry designed to mate with one or more different types of a wiring harness terminal of the electrical connector assembly. The modified hexagon geometry of the protrusion helps to prevent or eliminate unwanted rotation of one or more wires of the wiring harness terminal. In one preferred embodiment, the wiring harness terminal also has the modified hexagon geometry.

It will be appreciated that various components or features of the disclosed electrical connector assembly may vary from those depicted in the Figures and/or described herein. It will similarly be appreciated that various additional components or features of the disclosed electrical connector assembly may also be included, in addition to or instead of certain of the components and/or features depicted in the Figures and/or described herein. In addition, as mentioned above, it will also be appreciated that the disclosed electrical connector assembly may be utilized in connection with any number of different types of vehicles and/or components and/or modules thereof, and/or in connection with any number of other different types of devices and/or systems.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

We claim:

1. An electrical connector assembly having a wiring harness terminal, the electrical connector assembly comprising:

a body; and a protrusion extending from the body and configured to mate with the wiring harness terminal, the protrusion comprising six sides, with four of the sides having a first length, and two of the sides having a second length that is different from the first length.

2. The electrical connector assembly of claim 1, wherein the electrical connector assembly comprises a grounding stud.

3. The electrical connector assembly of claim 1, wherein the two of the sides having the second length are on opposite ends of the protrusion.

4. The electrical connector assembly of claim 1, wherein the protrusion has only six sides.

5. The electrical connector assembly of claim 1, wherein the second length is greater than the first length.

6. The electrical connector assembly of claim 1, further comprising:

a nut configured to attach the wiring harness terminal to the body.

7. The electrical connector assembly of claim 1, wherein the protrusion is formed integral with the body.

8. An electrical connector assembly having a wiring harness terminal, the electrical connector assembly comprising:

a body; and a protrusion extending from the body and configured to mate with the wiring harness terminal, the protrusion comprising:

a first surface having a first length;

a second surface connected to the first surface, the second surface having a second length;

a third surface connected to the second surface, the third surface having a third length;

a fourth surface connected to the third surface, the fourth surface having a fourth length;

a fifth surface connected to the fourth surface, the fifth surface having a fifth length; and a sixth surface connected to the fifth surface and the first surface, the sixth surface having a sixth length, wherein the third length and the sixth length are each different from the first length, the second length, the fourth length, and the fifth length.

9. The electrical connector assembly of claim 8, wherein:

the third length is equal to the sixth length; and the first length, the second length, the fourth length, and the fifth length are each equal to one another.

10. The electrical connector assembly of claim 8, wherein each of the third length and the first length are greater than each of the first length, the second length, the fourth length, and the fifth length.

11. The electrical connector assembly of claim 8, wherein the protrusion has only six surfaces.

12. The electrical connector assembly of claim 8, further comprising:

a nut configured to attach the wiring harness terminal to the body.

13. The electrical connector assembly of claim 8, wherein the electrical connector assembly comprises a grounding stud.

14. An electrical connector assembly comprising:

a grounding stud comprising:

a body; and a protrusion extending from the body, the protrusion comprising:

a first surface having a first length;

a second surface connected to the first surface, the second surface having a second length;

a third surface connected to the second surface, the third surface having a third length;

a fourth surface connected to the third surface, the fourth surface having a fourth length;

a fifth surface connected to the fourth surface, the fifth surface having a fifth length; and a sixth surface connected to the fifth surface and the first surface, the sixth surface having a sixth length, wherein the third length and the sixth length are each different from the first length, the second length, the fourth length, and the fifth length; and a wiring harness terminal coupled to and configured to mate with the protrusion.

15. The electrical connector assembly of claim 14, wherein:

the third length is equal to the sixth length; and the first length, the second length, the fourth length, and the fifth length are each equal to one another.

16. The electrical connector assembly of claim 14, wherein each of the third length and the first length are greater than each of the first length, the second length, the fourth length, and the fifth length.

17. The electrical connector assembly of claim 14, further comprising:

a nut attaching the wiring harness terminal to the grounding stud.

18. The electrical connector assembly of claim 14, wherein the protrusion has only six surfaces.

19. The electrical connector assembly of claim 14, wherein the wiring harness terminal comprises a face comprising:

a first face surface having a first face surface length; a second face surface connected to the first face surface, the second face surface having a second face surface length;

a third face surface connected to the second face surface, the third face surface having a third face surface length;

a fourth face surface connected to the third face surface, the fourth face surface having a fourth face surface length;

a fifth face surface connected to the fourth face surface, the fifth face surface having a fifth face surface length; and a sixth face surface connected to the fifth face surface and the first face surface, the sixth face surface having a sixth face surface length, wherein the third face surface length and the sixth face surface length are each different from the first face surface length, the second face surface length, the fourth face surface length, and the fifth face surface length.

20. The electrical connector assembly of claim 19, wherein:

the third face surface length is equal to the sixth face surface length;

the first face surface length, the second face surface length, the fourth face surface length, and the fifth face surface length are each equal to one another; and each of the third face surface length and the first face surface length are greater than each of the first face surface length, the second face surface length, the fourth face surface length, and the fifth face surface length.

* * * * *